US006318877B1

(12) United States Patent
Dehn

(10) Patent No.: US 6,318,877 B1
(45) Date of Patent: Nov. 20, 2001

(54) TRAVEL LIGHTS VANITY

(76) Inventor: Corrina Sue Dehn, 1398 NE. 39 St., Oakland Park, FL (US) 33334

( * ) Notice: Subject to any disclaimer, the term of this patent is extended or adjusted under 35 U.S.C. 154(b) by 0 days.

(21) Appl. No.: 09/453,830

(22) Filed: Feb. 16, 2000

(51) Int. Cl.[7] ..... F21V 21/30

(52) U.S. Cl. ..... 362/136; 362/141; 362/250; 362/413

(58) Field of Search ..... 362/135, 136, 362/140–144, 227, 234, 235, 241, 247, 249–252, 492, 511, 382, 410, 413, 418, 427; 248/343, 460

(56) References Cited

U.S. PATENT DOCUMENTS

| | | | | |
|---|---|---|---|---|
| Re. 25,402 | * | 6/1963 | Myerberg | 362/141 |
| 960,596 | * | 6/1910 | Spinner | 362/136 |
| 1,859,592 | * | 5/1932 | Marchand | 362/141 |
| 2,201,251 | * | 5/1940 | Van Patten | 362/141 |
| 3,368,068 | * | 2/1968 | Cronheim | 362/141 |
| 3,381,120 | * | 4/1968 | Fleisher et al. | 362/136 |
| 3,737,646 | * | 6/1973 | Burrows | 362/140 |
| 5,272,609 | * | 12/1993 | Nelson | 362/250 |
| 5,392,162 | * | 2/1995 | Glucksman | 362/140 |
| 5,660,117 | * | 8/1997 | Noble | 248/460 |
| 6,126,134 | * | 10/2000 | Adkins | 248/460 |
| 6,179,258 | * | 1/2001 | Dell'Aquila | 362/252 |

* cited by examiner

*Primary Examiner*—Alan Cariaso
(74) *Attorney, Agent, or Firm*—Carothers & Carothers

(57) ABSTRACT

A portable vanity having an inverted U-shaped light bar frame with two spaced upright side light bars and a top horizontal light bar bridging and respectively hingedly connected at opposite ends to upper ends of the side light bars whereby the side bars hinge inwardly toward each other. The two side light bars and the top light bar are each comprised of two end to end light bar segment hinged together between segments whereby each segmented light bar folds inwardly at their segment hinge toward the inside of the U-shaped frame such that the frame collapses with the bar segments sequentially adjacent each other in parallel alignment. A securing mechanism is provided for securing the light bar segment hinge connections from hinge movement when the frame is fully assembled in its open position in its inverted U-shaped configuration. The light bar segments include electric light bulb sockets wired for energization of electric bulbs to be inserted in the sockets.

2 Claims, 3 Drawing Sheets

TRAVEL LIGHTS VANITY

BACKGROUND OF THE INVENTION

This invention relates to the field of portable, yet full-sized, fully illuminated travel vanities, and in particular, to such vanities having a collapsible, folding framework with two removable base supports which provide stability to, and restrict movement of, the vanity frame.

There are, of course, various designs for illuminated, portable vanities which can be used for travel. These would include ones such as Southam U.S. Pat. No. 856,497; Herbold U.S. Pat. No. 1,968,342; Wickwire U.S. Pat. No. 2,480,800; Gernsback U.S. Pat. No. 1,057,820; Morey U.S. Pat. No. 2,235,109; Ohrenstein et al. U.S. Pat. No. 4,091, 443; and Dieterle U.S. Pat. No. 4,745,528.

However, the prior art does not appear to show a travel vanity which has a collapsible, folding framework that, when unfolded, expanded, and assembled serves as a free-standing, full-sized illuminated travel vanity, and which when disassembled, collapsed and folded-up, measures a distance of 22 inches wide by 23 inches high. In its collapsed and folded state, the invention fits neatly into a compact carrying case which promotes ease of storage of the device, in addition to promoting ease of transport.

BRIEF SUMMARY OF THE INVENTION

The invention is designed to overcome the problems with prior known illuminated travel vanities such as those noted above. This invention provides a full-size vanity, rather than a compact-sized vanity, which provides full illumination when assembled and expanded for use. Once assembled, the vanity can be used in a home setting and left assembled for daily use while applying make-up or dressing hair, or the vanity could be disassembled and collapsed for use during travel. The known prior art, such as Dieterle U.S. Pat. No. 4,745,528, does not provide the level of illumination that this invention provides. Many times make-up is over-applied or under-applied to the face due to lack of ample lighting in the home or hotel room accommodations during travel. For instance, many hotel accommodations in the U.S. and Europe fail to provide sufficient lighting in which one would be able to apply make-up and achieve the desired make-up tones. Many hotel accommodations, however, provide desks for travelers to utilize for work during their stay at the hotels. This device is designed so that it could be assembled and erected on a desktop or hotel vanity. The user could then sit at the desk and apply her make-up or dress her hair with proper lighting provided by the full-sized vanity lights. The mirror is incidental. The device could be packaged to include any standard reversible mirror, or the user could utilize her own mirror.

DETAILED DESCRIPTION OF THE DRAWINGS

DETAILED DESCRIPTION OF THE INVENTION

Figure 3:
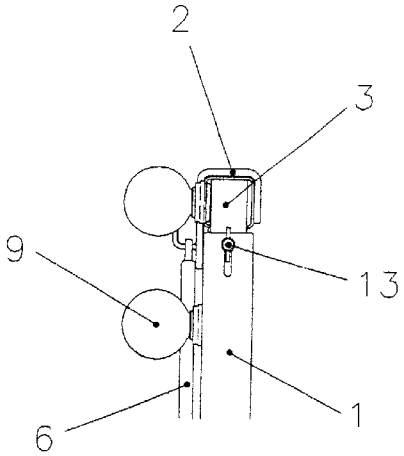
FIG. 3 is a 1.5× section view showing a closer detail of FIG. 2.
Figure 1:
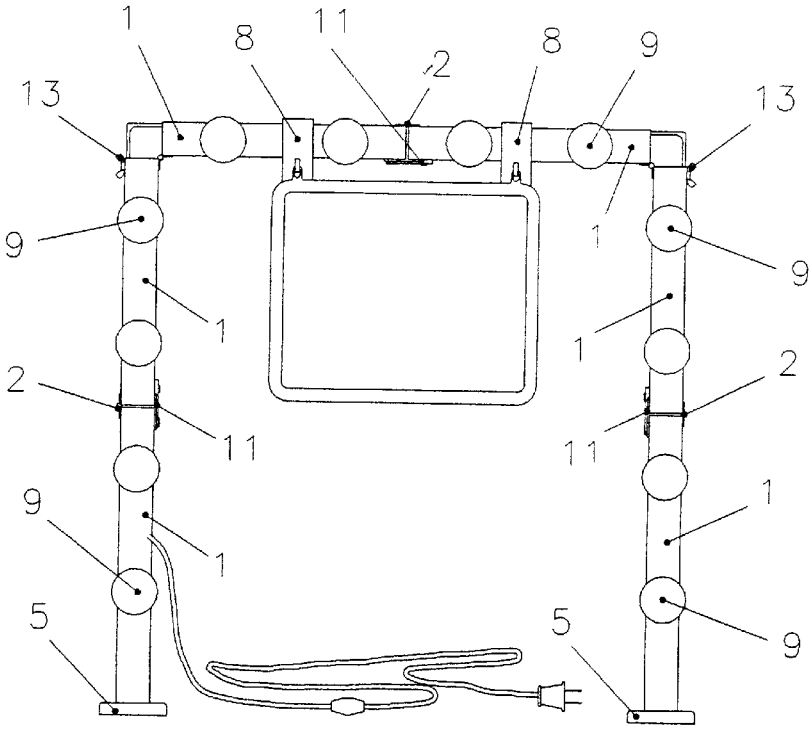
FIG. 1 is a front elevation of the vanity showing it fully assembled.
Figure 2:
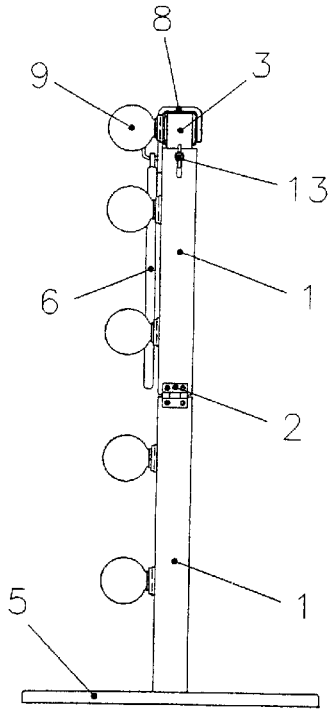
FIG. 2 is a side elevation of the vanity fully assembled.
Figure 5:
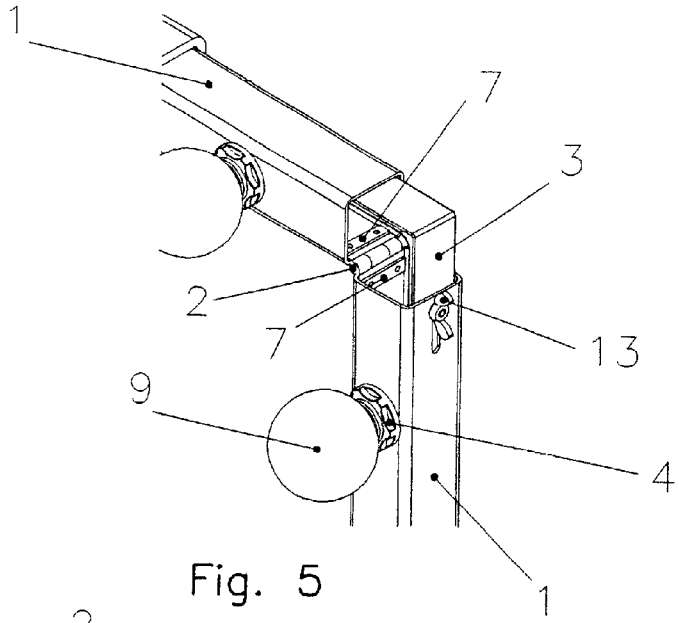
FIG. 5 is a 1.5× section view showing a closer detail of FIG. 4.
Figure 4:
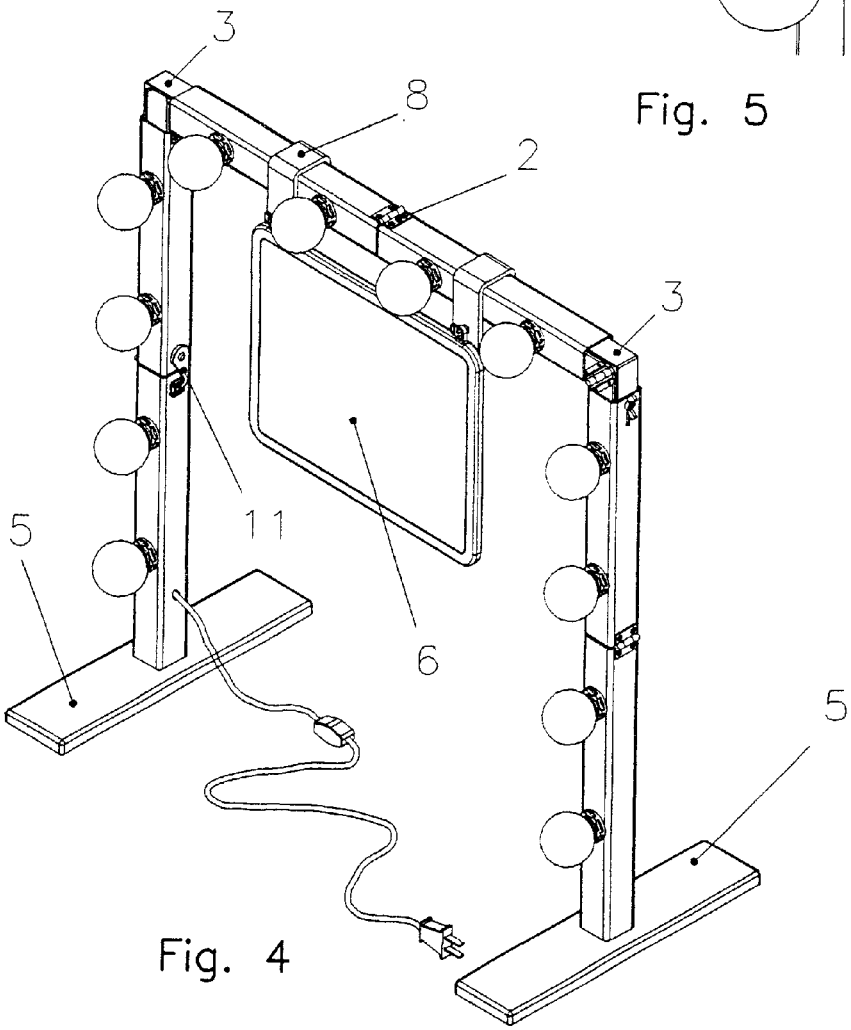
FIG. 4 is a front perspective of the vanity.
Figure 7:
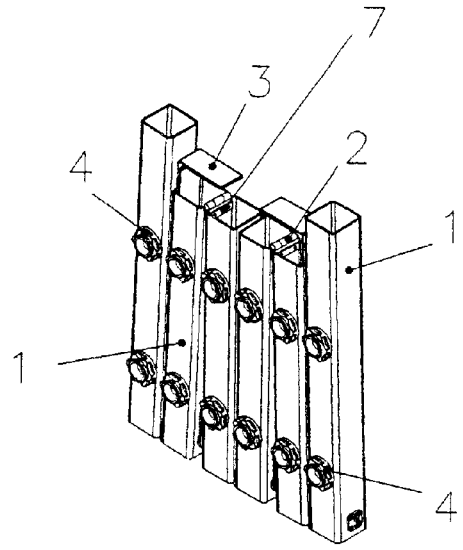
FIG. 7 is showing the vanity disassembled and folded so it can be placed inside the carrying case (10).
Figure 6:
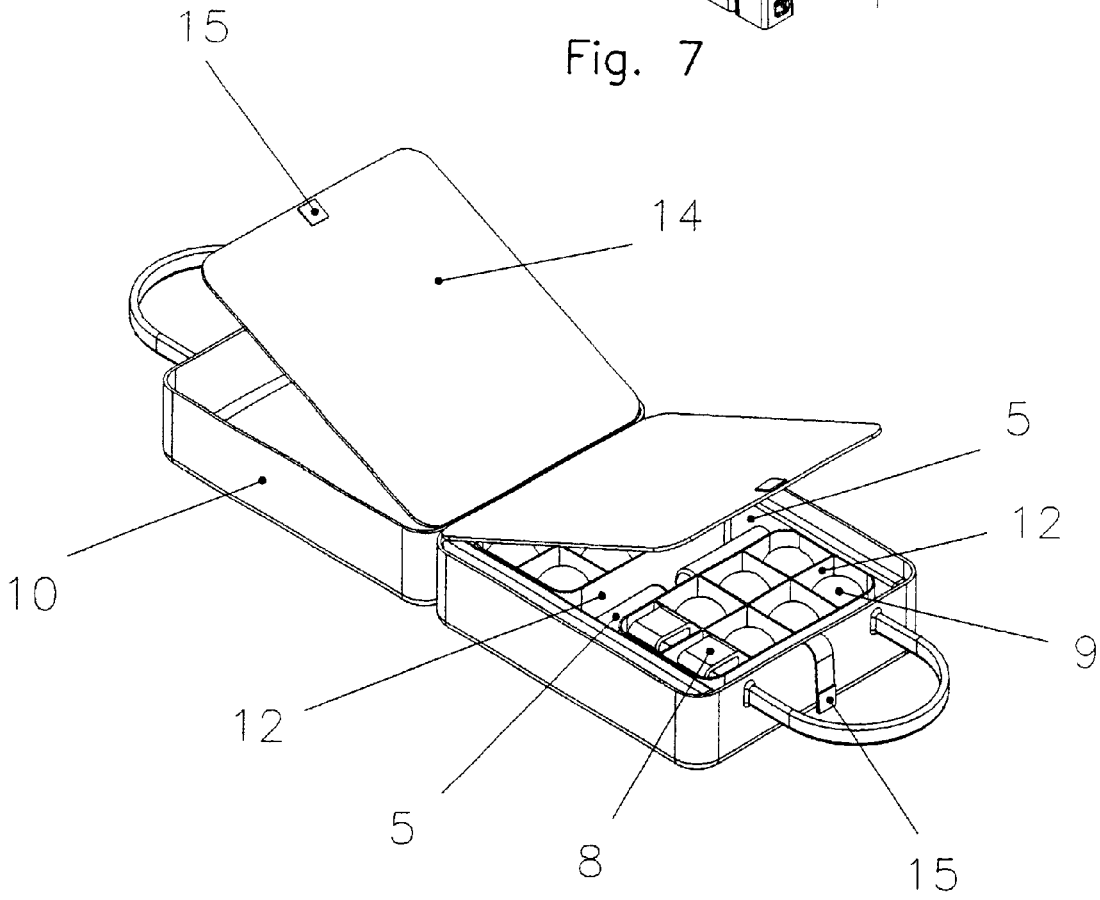
FIG. 6 is showing the carrying case (10) with the light bulbs (9) and the bases (5) and the mirror hooks (8) packed inside.

A full-sized, illuminated, travel vanity is provided having a detachable reversible mirror (6), the obverse side of which reflects images at normal magnitude, and the reverse side of which reflects a magnified image. The framework of the prototype device consists of three sets of two hollow 2 by 12 and 4 by 10 inch light bar segments (1) fabricated from a lightweight, polyvinyl chloride. Each set of light bar segments (1) is permanently adjoined by a standard piano hinge (2) at their ends so as to create an affixed pair of light bar segments (1). The hinge (2) of each pair of light bar segments (1) is attached to the exterior sides of the bar segments allowing the bar segments to fold inward and outward. When folded to the inverse position, the pair of bar segments collapses so that each light bar segment rests snugly parallel to each other when closed (FIG. 7).

The ends of two pairs of the light bar segments (1), when unfolded and extended, are next fitted to the detachable base supports (5). The base supports (5) of the prototype device consist of two pieces of wood cut into elongated rectangular shapes. Each base support (5) measures 12 inches long by 2½ inches wide by ¾ inches high. A round wooden base peg (5) measuring 1 inch in circumference and 2 inches high is permanently affixed to, and protruding upward from the center of each base support. Two pairs of light bar segments (1) are unfolded and extended, then the round wooden peg of each base support (5) is inserted into one of the light bar segments (1) so that once attached, the side light bars are standing erect. The support bracket (3) is then inserted into each of the upright light bars. To maintain stability, a standard "J" latch assembly (11) secures the light bar segments (1) into the extended position. The third and last pair of light bar segments (1) is unfolded and extended and each open end of this horizontal light bar is inserted into the support bracket (3). This horizontal light bar (the overhead light bar) is affixed into place in the support bracket (3) by means of a wing nut (13), which protrudes from the exterior of each erect or upright light bar. The vanity is now assembled and the light bulbs (9) are next inserted into the device. Each light bar segment (1) contains 2 standard electrical sockets (4) which operate on direct current. A total of twelve standard 25 watt vanity type bulbs (9) are utilized in the device. The light bulbs (9) are inserted into each socket one at a time. The device is now fully-assembled and ready for use. The user may use the mirror provided (6) which is a standard mirror attached to two U-hooks (8) which slip over the top of the overhead light bar so that the mirror hangs from the overhead light bar. For disassembly of the device, the user merely reverses the steps taken to assemble and erect the device by first removing the hanging mirror (6), then removing all of the light bulbs (9), then unscrewing the wing nuts (13), then unlatching the J-hook latches (11), then removing all three pairs of light bars (1) and folding them down into the closed position. The base supports are removed (5), and the light bars (1) and base supports (5) are ready for insertion into the carrying case. The carrying case (10) is a double-sided bag fabricated from nylon or any similar synthetic fiber material. The carrying case (10) is connected at the bottom center and folds inward. The left side of the carrying case (10) holds the light bar segments (1), base supports (5), and mirror (6), which are secured into position by means of a hard cover (14) which may be fabricated from cardboard coated with nylon or another similar material. The right side of the carrying case holds the mirror hooks (8), light bulbs (9) and the round base pegs (5). Each light bulb is stored in a compartmentalized bulb separator (12) structure which can be fabricated from cardboard or from impact absorbing foam or plastic. The contents of the right side of the carrying case (10) are secured by means of a hard cover (14) which may be fabricated from cardboard coated with nylon or another similar material. Each side is secured with VELCRO hook and loop fasteners (15). The carrying case (10) is then folded and secured into the closed position by means of a zipper.

I claim:

1. A portable vanity comprising:

an inverted U-shaped light bar frame having two spaced upright side light bars and a top horizontal light bar bridging and respectively hingedly connected at opposite ends to upper ends of said side light bars whereby said side bars hinge inwardly toward each other;

at least one of said side and top light bars comprised of two end to end light bar segments hinged together between segments whereby each segmented light bar folds inwardly at the segment hinge toward the inside of said U-shaped frame such that said frame collapses with said bar segments sequentially adjacent each other in parallel alignment;

all of said light bars are comprised of two hinged light bar segments;

securing means for selectively securing said light bar segment hinge connections from hinge movement when said frame is fully assembled in its inverted U-shaped configuration; and said light bar segments include electric light bulb sockets wired for energization of electric bulbs to be inserted in said sockets.

2. The portable vanity of claim 1 including a travel case dimensioned for storing said light bar frame in its collapsed folded state.

* * * * *